US009780507B2

(12) United States Patent
Li

(10) Patent No.: US 9,780,507 B2
(45) Date of Patent: Oct. 3, 2017

(54) DOUBLE-SIDE AND DUAL-PURPOSE CONNECTOR

(71) Applicant: Shenzhen WuXiang Electronics & Technology Co., Ltd, Shenzhen (CN)

(72) Inventor: Jing Li, Shenzhen (CN)

(73) Assignee: SHENZHEN WUXIANG ELECTRONICS & TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 15/190,452

(22) Filed: Jun. 23, 2016

(65) Prior Publication Data

US 2017/0155221 A1 Jun. 1, 2017

(30) Foreign Application Priority Data

Dec. 1, 2015 (CN) ..... 2015 2 0989325 U
Feb. 5, 2016 (CN) ..... 2016 2 0117094 U
Mar. 28, 2016 (CN) ..... 2016 1 0184476
Apr. 29, 2016 (CN) ..... 2016 2 0391379 U

(51) Int. Cl.
*H01R 27/00* (2006.01)
*H01R 13/639* (2006.01)

(52) U.S. Cl.
CPC ..... *H01R 27/00* (2013.01); *H01R 13/639* (2013.01)

(58) Field of Classification Search
CPC ..... H01R 13/648; H01R 13/658; H01R 13/6581; H01R 13/6582; H01R 13/6583; H01R 13/6591; H01R 13/6592; H01R 13/6593; H01R 13/6594; H01R 13/6595
See application file for complete search history.

(56) References Cited

U.S. PATENT DOCUMENTS 9,356,406 B2 * 5/2016 Yen ..... H01R 13/6585

* cited by examiner

*Primary Examiner* — Ross Gushi
(74) *Attorney, Agent, or Firm* — Ming Chow; Sinorica, LLC

(57) ABSTRACT

The utility model claims a double-side and dual-purpose connector, comprising a terminal component and a shell, wherein the terminal component comprises a first terminal and a second terminal which are in isolated setting and adapt to different data interface types; different types of data interfaces can be connected by the first terminal and the second terminal; and the shell is tightly sleeved outside the terminal component to limit and fix the terminal component. The connector provided in the utility model is convenient to use and capable of being compatible with different types of data interfaces and matching with the interface of electronic equipment, such as existing cell phone, etc.

19 Claims, 11 Drawing Sheets

DOUBLE-SIDE AND DUAL-PURPOSE CONNECTOR

The current application claims foreign priority to application numbers 201610184476.4 filed on Mar. 28, 2016 in China, 201620117094.5 filed on Feb. 5, 2016 in China, 201520989325.7 filed on Dec. 1, 2015 in China, and 201620391379.8 filed on Apr. 29, 2016 in China.

TECHNICAL FIELD

The utility model belongs to the technical field of phone accessories and relates to a connector, specifically a double-side and dual-purpose connector.

BACKGROUND ART

The current I/O connector is one of important access passages of electronic equipment, such as cell phone, including power and signal. The cell phone, table PC and the like have been respectively researched by the manufacturer for a long time; different standards have been formulated, so the current cell phone and table product adopt different standards; the data wire has multiple interfaces which are divided into two types: one is special data interface of Apple products; and the other is data interface for Android system products which is frequently used by the manufacturers; there are many corresponding connectors; the connectors cannot be used universally, so it is not convenient; and it requires different connectors when using different data.

SUMMARY

Aiming at the defects of the prior art, the technical problem to be solved in the utility model is to provide a connector which is convenient to use and capable of being compatible with different types of data interfaces and matching with the interface of electronic equipment, such as existing cell phone, etc.

The technical scheme adopted to solve the technical problem of the utility model is as follows: a double-side and dual-purpose connector, comprising a terminal component and a shell, wherein the terminal component comprises a first terminal and a second terminal which are in isolated arrangement and adaptable to different data interface types; different types of data interfaces can be connected by the first terminal and the second terminal;

the shell is tightly sleeved outside the terminal component to limit and fix the terminal component.

In the double-side and dual-purpose connector, the connector further comprises a backbase fixed at the rear portion of the terminal component, so that the terminal component is fixedly and integrally connected with the shell; and the rear end of the terminal component extends from the rear portion of the backbase.

In the double-side and dual-purpose connector, the connector further comprises an elastic buckle inserted into the terminal component; the front portion of the elastic buckle extends from both sides of the terminal component and the shell; and the elastic buckle and the backbase are limited and fixed by the terminal component to prevent the elastic buckle from moving.

In the double-side and dual-purpose connector, the backbase is provided with a through groove; the shape of the through groove matches with that of the rear portion of the terminal component to be inserted together; and the shell is pressed between the front end of the terminal component and the backbase.

In the double-side and dual-purpose connector, the inner wall of the through groove and the rear portion of the terminal component are respectively provided with a neck and a chuck; and the separation between the backbase and the terminal component can be limited after the neck is connected with the chuck, In the double-side and dual-purpose connector, a resisting shrapnel is arranged in the middle portion or rear portion of the elastic buckle; and the resisting shrapnel is pressed against the top pressing groove provided on the backbase to prevent the elastic buckle from moving backwards.

In the double-side and dual-purpose connector, an anti-falling mechanism preventing the connector from being inserted and falling is arranged on the shell or/and the terminal component.

In the double-side and dual-purpose connector, the first terminal is a Lighting data interface terminal; the second terminal is a Micro-USB interface; the terminal components can realize connection with the Light data interface and the Micro-USB interface from the respective side;

In the double-side and dual-purpose connector, the backbase is connected with the back of the terminal component to realize fixed connection of the backbase and the terminal component; the shell is held between the front end of the terminal component and the backbase to prevent the shell from moving longitudinally;

In the double-side and dual-purpose connector, the elastic buckle is inserted into the terminal component from the rear portion of the terminal component and the transverse movement is limited by the shell; the elastic chuck at the front end of the elastic buckle extends from the terminal component at one side of Micro-USB interface; and the elastic buckle is longitudinally limited and fixed between the terminal component and the backbase to prevent the longitudinal moving thereof.

In the double-side and dual-purpose connector, the terminal component comprises a first terminal component with a Lighting data interface and a second terminal component with a micro-USB interface; the first terminal component and the second terminal component are stacked to limit and fix the front, rear, right and left sides by concave-convex matching.

In the double-side and dual-purpose connector, the second terminal component is provided with a containing groove; the first terminal component is embedded in the containing groove; the rear portion of the containing groove is opened; the rear of the first terminal component extends backwards from the opening of the containing groove; the two sides of the containing groove are provided with locating grooves; the two sides of the corresponding first terminal component are provided with locating pieces; and the locating piece is inserted into the locating groove to limit the longitudinal moving of the first terminal component.

In the double-side and dual-purpose connector, the elastic buckle comprises two elastic chucks arranged in parallel and in interval; the rear portions of the two elastic chucks are integrally connected; the corresponding second terminal component is provided with a buckle groove respectively; the elastic chucks are contained in the buckle grooves; and the front end of the elastic chuck extends outwards from the connection opening of the buckle groove and the shell.

In the double-side and dual-purpose connector, the backbase is provided with a through groove; a locking groove is set on the inner wall of the through groove; a baffle plate is arranged at the front end of the terminal component; the front end of the shell is pressed against the baffle plate; and the rear end of the shell pressed against the locking groove by the locking piece.

In the double-side and dual-purpose connector, the terminal component further comprises a module body; the first terminal and the second terminal are fixed and separated by the module body to realize connecting the terminal; and the front connection portion of the first terminal and the front end connection portion of the second terminal are arranged at the front of the module body.

In the double-side and dual-purpose connector, the module body comprises a first module body used for fixing the first terminal and a second module body used for fixing the second terminal; and the first module body and the second mould body are stacked to limit and fix the front, rear, right and left sides by concave-convex matching.

In the double-side and dual-purpose connector, the elastic buckle comprises two elastic chucks arranged in interval and in parallel; the rear portions of two elastic chucks are integrally connected by the buckle; the second module body is provided with a buckle groove; the elastic chuck is contained in the buckle groove; and the front end of the elastic chuck extends outwards from the connection opening corresponding to the buckle groove and the shell.

In the double-side and dual-purpose connector, the shift groove for containing the movement of the connection portion at the front end of the second terminal is set at the front back of the first module body; the shift groove faces the front end of the second terminal, so that the second terminal is pressed and shifted in the shift groove after the connector is inserted into the cell phone data interface.

In the double-side and dual-purpose connector, the shell is in full-surrounded structure or cylindrical structure with front and rear opening; the terminal component is wrapped and fixed; the front part of the shell is provided with the first connection opening; the front end is provided with a second connection opening; the rear end is provided with a third connection opening; the front end connection portion of the first terminal is arranged in the first connection opening; the second connection opening corresponds to the front end connection portion of the second terminal; and the rear connection portions of the first terminal and the second terminal extend backwards from the third connection opening.

In the double-side and dual-purpose connector, a plugging locking piece for increasing the plugging force of the terminal is provided on the terminal component corresponding to the second connection opening.

In the double-side and dual-purpose connector, the front portion and the rear portion of the terminal component are provided with blocking pieces to limit and fix the shell.

In the double-side and dual-purpose connector, an arc-shaped wall matching with the data interface shape is provided at the two sides of front ends of the shell or/and terminal component; and the inclined face matching with another data interface shape is arranged longitudinally at the two sides of the shell.

The utility model adopts double-side and dual-purpose connector; the two sides of the terminal component can realize the connection between different data interfaces. The connector can be compatible with the Apple phones and other Android system phones; when the connector is used, the different corresponding data interfaces are connected with the data interfaces on the cell phone; it is convenient to use, so the phone user does not need to select otherwise. The connector can solve the cell phone charging and data transmission function of all phones.

BRIEF DESCRIPTION OF THE DRAWINGS

The utility model is further described by the drawings and embodiments, in the drawings.

SPECIFIC EMBODIMENTS

Figure 1:
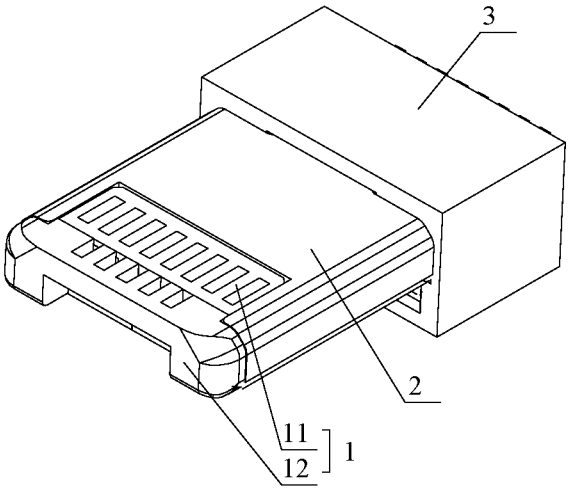
FIG. 1 is the structure diagram of the Embodiment 1 in the utility model.
Figure 2:
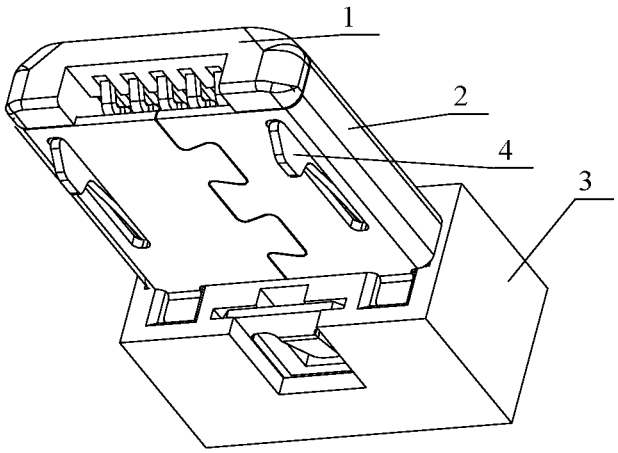
FIG. 2 is the whole upward structure diagram of the Embodiment 1 in the utility model.

In order to understand the technical feature, purpose and effect of the utility model clearly, the specific embodiments of the utility model are described in details according to the drawings.

As shown in FIGS. 1-21, a double-side and dual-purpose connector, its basic structure comprises a terminal component 1 and a shell 2; the terminal component 1 comprises a first terminal and a second terminal which are in isolating setting and adapt to different data interface types; different types of data interface connections can be realized by the first terminal and the second terminal respectively; the shell 2 is tightly sleeved outside the terminal component 1 to limit and fix the terminal component 1. The terminal component 1 and the shell 2 are basic structures, whereas the backrest and elastic buckle are additional structures or preferred structure. In addition, the anti-falling mechanism and pulling locking piece are optional structure which can be selected or not selected. The invention will be elaborated with reference to various embodiments below.

Embodiment 1 as shown in FIGS. 1-6, a double-side and dual-purpose connector is provided, it comprises a terminal component 1, a shell 2, a backbase 3 and an elastic buckle 4; a respective side of the terminal component 1 can realize Light data interface and Micro-USB interface connections; the shell 2 is tightly sleeved outside the terminal component 1 to limit and fix the terminal component 1 transversely; the backbase 3 is fixedly connected with a rear portion of the terminal component 1; the shell 2 is held between a front end of the terminal component 1 and the backbase 3 to prevent the shell 2 from moving longitudinally; the elastic buckle 4 is inserted frontward into the terminal component 1 from the rear portion of the terminal component 1; the elastic chuck 41 at the front end of the elastic buckle 4 extends outward from the terminal component 1 on the side of Micro-USB interface; and the elastic buckle 4 is limited and fixed with the backset 3 by the terminal component 1 to prevent its longitudinal moving.

Figure 4:
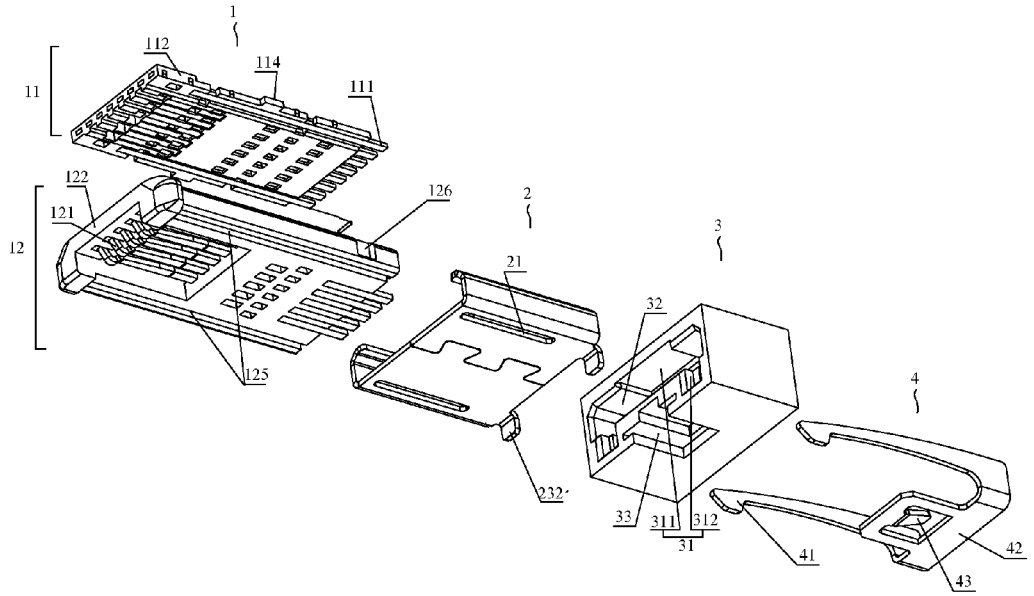
FIG. 4 is the structure explosive diagram in another direction of the Embodiment 1 in the utility model.
Figure 5:
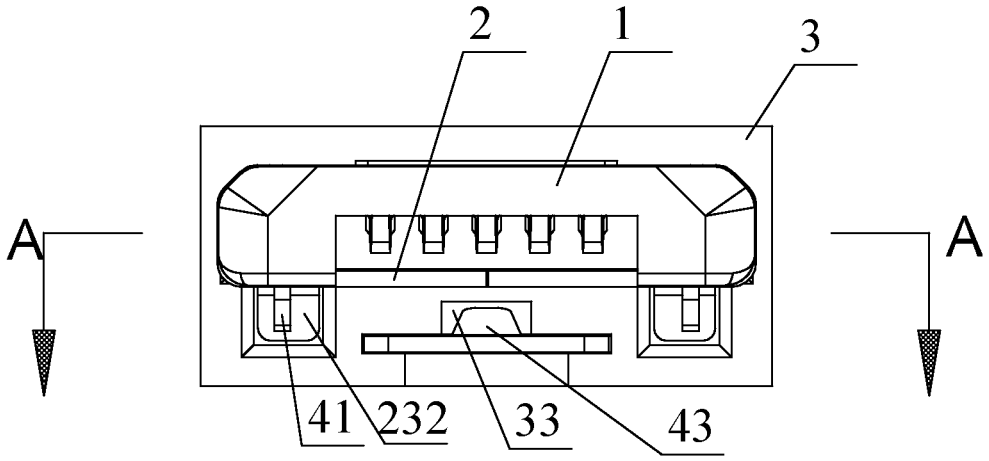
FIG. 5 is the top view of the Embodiment 1 in the utility model.
Figure 6:
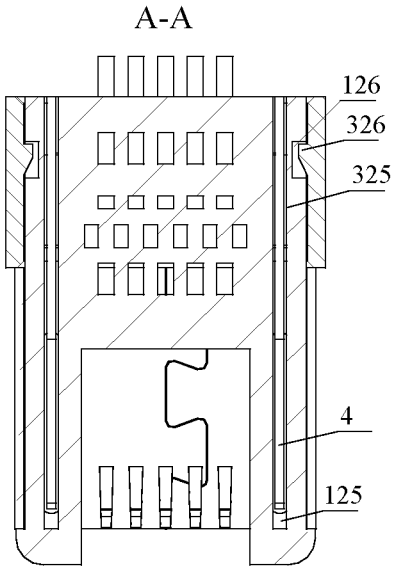
FIG. 6 is A-A section view in FIG. 5.

The utility model adopts a double-side and dual-purpose connector 1 can meet different phones corresponding to Lightning data interface and Micro-USB interface by providing the first terminal is Lightning data interface terminal 111 and the second terminal is Micro-USB interface terminal 121. As shown in FIGS. 4 and 5, the terminal component 1 comprises a Lightning data interface terminal 111, a Micro-USB interface terminal 121 and a plastic mold top for fixing and isolating each terminal; the plastic mold top of corresponding Lightning data interface terminal 111 and Micro-USB interface terminal 121 can be integrated structure or separated structure. An integrated structure refers to the Lightning data interface terminal and Micro-USB interface terminal are assembled on one plastic mold top; a separated structure refers to the Lightning data interface 111 and Micro-USB interface terminal 121 are respectively assembled on respective plastic mold tops. Structures of the Lighting data interface terminal 111 and Micro-USB interface terminal 121 are same as the structure of conventional Lighting data interface terminal and Micro-USB interface terminal in the prior art, and it is not explained here.

As shown in FIGS. 1-4, the separated structure in the embodiment is as follows: a terminal component 1 comprises a first terminal component 11 with a Lightning data interface and a second terminal component 12 with a Micro-USB interface; the first terminal component 11 and the second terminal component 12 are stacked to limit and fix the front, rear, right and left sides by convex-concave matching. The first terminal component 11 comprises a Lightning data interface terminal 111 and a first terminal plastic mold top 112; the second terminal component 12 comprises a Micro-USB interface terminal 121 and a second terminal plastic mold top 122. The assembly process of the Lightning data interface terminal 111, the first terminal plastic mold top 112, the Micro-USB interface terminal 121 and the second terminal plastic mold top 122 is the same as that the prior art, and is not explained here.

Figure 3:
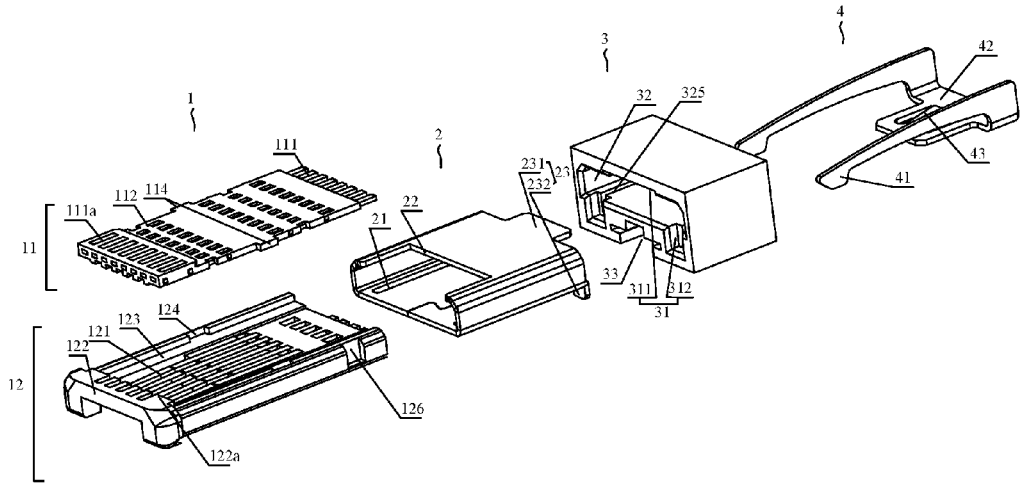
FIG. 3 is the structure explosive diagram of the Embodiment 1 in the utility model.

As shown in FIGS. 3 and 4, the second terminal component 12 is provided with a containing groove 123; the first terminal component 11 is embedded in the containing groove 123 to realize convex-concave matching; a rear portion of the containing groove 123 is opened; and a rear portion of the first terminal component 11 extends backwards from the opening of the containing groove 123. The containing groove 123 is specifically arranged on the second terminal plastic mold top 122; and the first terminal component 11 is embedded completely in the containing groove 123. The embedded first terminal component 111 and the second terminal component 12 can form left, right limitations and frontwards limitation.

Two walls of the containing groove 123 are provided with respective locating grooves 124; the two sides of the first terminal plastic mold top 112 of the corresponding first terminal component 11 are provided with locating pieces 114; the locating piece 114 is inserted into the locating groove 124 to limit the backwards movement of the first terminal component 11. The shape of the locating groove 124 matches with the shape of the locating piece 114; which is not required to be furthered defined as long as position limitation between the two pieces can be achieved. The locating groove 124 in the embodiment is preferably square groove; and the locating piece 114 is square.

As shown in FIGS. 1-4, the shell 2 is tightly sleeved outside the terminal component 1. The shell 2 is made from metal material, which can realize grounding on one hand; and transversely limited and fix the terminal component ion the other hand. The shape of the shell 2 is consistent to that of the existing connector so as to replace the existing connector directly. A connection opening 21 is provided at the reverse face of the shell 2 from which the elastic buckle 4 can extend out; the front face of the shell 2 has a window 22 through which eight pins 111*a* of the Lightning data interface terminal 111 are exposed to realize the electric connection with phone interfaces.

The shell 2 is held between the front end of the terminal component 1 and the backbase 3 to prevent the shell 2 from moving longitudinally. Specifically, the front end of the terminal component 1, namely, the front end of the second terminal plastic mold top 122 is provided with a baffle plate 122*a*; and the front end of the shell 2 is pressed against the baffle plate 122*a* to realize limitation in the forward direction. In the embodiment, the side walls at the front of the containing groove 113 is the baffle plate 122*a* which both form the containing groove 123 and limit the shell 2 longitudinally. The inner wall of the through groove 32 of the backbase 3 is provided with a stop groove 31; the front end of the shell 2 is pressed against the baffle plate 122*a*; and the rear end of the shell 2 is pressed against the locking groove 31 by the locking piece 23.

As shown in FIG. 1-4, the elastic buckle 4 comprises two elastic chucks 41 arranged in parallel and spaced apart; the shape, position and action of the elastic chucks 41 are the same as the elastic chuck 41 in Micro-USB interface in the prior art so as to achieve versatility to interface of the current phone. Rear portions of the two elastic chucks 41 are connected together by a buckle base 42.

The side corresponding to the second terminal component 12 is provided with a buckle groove 125; the buckle groove 125 is longitudinally arranged along the second terminal component 121; it is specifically arranged longitudinally on a surface of the wall of the second terminal plastic mold top 122; the buckle groove 125 is a three-directional semi-surrounding structure with a back opening; the rear opening is used for pushing and assembling the elastic buckle 4 to the buckle groove 125 from the opening; the elastic buckle 41 is contained in the buckle groove 125; the front end of the elastic chuck 41 extends from the connection opening 21 corresponding to the buckle groove 125 and shell 2; after the terminal component 1, the shell 2 and the elastic buckle 4 are assembled, the elastic buckle 4 is limited and fixed in five directions apart from the backward direction.

The shell 2 and the elastic buckle 4 are fixed backwards by the backbase 3. The front face and back face of the shell 2 are provided with stop pieces 23; the stop groove 31 is arranged on the corresponding backbase 3; the stop piece 23 is pressed against the locking groove 31 on the backbase 3 to limit the shell 2 backwards; and the position of the stop groove 31 can be on the outer wall and the front end of the backbase 3 as well as the inner wall of the backbase 3. The stop piece 23 comprises a first stop piece 231 and a second stop piece 232; and a first locking groove 311 and a second stop groove 312 are arranged on the backbase 3 correspondingly. The back end at the front of the shell 2 extends backwards to form the first stop piece 231; the first stop piece 231 is optimally set in the center at the rear end of the shell 2; the second stop piece 232 is set at the back face of the shell 2; the second stop piece 232 is the turnover side turned from the rear end of the shell 2 outwards; the turnover side can be one or more than one, corresponding to the first locking piece 231 and the second locking piece 232, the first locking groove 311 and the second locking groove 312 are set on the inner wall surface of the through groove at the front end of the backbase 3.

As shown in FIG. 4, the backward limiting of the elastic buckle 4 is realized by the pressing the resisting shrapnel 43 arranged in the middle or back part of the elastic buckle 4 to the backbase 3; and the resisting shrapnel 43 is pressed against a top groove 33 arranged on the backbase 3 to prevent the elastic buckle 4 from moving backwards. The top groove 33 can be arranged on the outer wall or the front end surface of the backbase 3 and the inner wall of the backbase 3.

The backbase 3 is provided with a through groove 32; the shape of the through groove 32 matches with that of the rear portion of the terminal component 1 to be inserted together; and the shell 2 is pressed against a portion between the front end of the terminal component 1 and the backbase 3.

As shown in FIGS. 3-6, in order to fix the inner wall of the through groove 32 between the terminal component 1 and the backbase 3, the rear portion of the terminal component 1 is provided with a neck 126 and a chuck 326; and the connected neck 126 and chuck 326 can limit the separation of the backbase 3 and the terminal component 1. The neck is arranged on the inner wall of the through groove 32; the chuck is correspondingly provided on the outer wall at the rear portion of the terminal component 1; or the chuck 326 is arranged on the inner wall of the through groove 32; the neck 126 is correspondingly provided on the outer wall face at the back of the terminal component 1; the position does not need to be particularly defined as long as the neck 126 can be connected with the terminal component 1. In the embodiment, the neck 126 is optimally set on the terminal component 1, namely, the two sides of the second terminal plastic mold top 122; and the chuck 326 is set on the inner wall surfaces at the two sides of the through groove 32. The shapes of the chuck 326 and the neck 126 are not limited, they can be in any shape that can not be separated after being connected; and preferably a hook is formed between the neck 126 and the chuck 326 to avoid retreat and separation of the backbase 3.

As shown in FIGS. 3-6, assemble of the elastic buckle 4 starts from the backbase 3; the backbase groove 325 corresponding to the buckle groove 125 is also arranged in the corresponding through groove 32; the backbase groove 325 corresponds to the buckle groove 125 to form a groove in which the elastic buckle 4 can be advanced forward. With respect to the fixation of the elastic buckle 4, it is preferable to arrange the resisting groove 33 on the inner wall surface at the front portion of the through groove 32; a front portion of the resisting shrapnel 43 is inclined in the direction of the backbase 3; after the elastic buckle 4 is assembled on the terminal component 1, the resisting shrapnel 43 is pressed against the top groove 33 to prevent retreat of the elastic buckle 4.

The two sides at the front end of the shell 2 or/and terminal component 1 are provided with arc-shaped wall surfaces matching with the data interface shape; the structure is suitable for the data interface shape of Apple products; and the two sides of the shell 2 are provided longitudinally with an inclined surface for matching with the other data interface shape, the data interface shape of Android system product.

Embodiment 2 as shown in FIGS. 7-11, it is the second embodiment method of the double-side and dual-purpose connector, including a terminal component 1, a shell 2, a backbase 3 and an elastic buckle 4; the terminal component 1 comprises a module body 100, a first terminal 111 and a second terminal 121 used for different data interfaces; the first terminal 111 and the second terminal 121 are fixed and separated by the module body 100 to realize individual terminal connections respectively. The front connection portion 111*a* of the first terminal 111 and the front connection portion 121*a* of the second terminal 121 are located at the front portion of the module body 100. The first terminal 111 and the second terminal 121 are two different terminals which are respectively used for the connection terminals of Apple product and Android system product, for example, the first terminal 111 is Lightning data interface; the second terminal 121 is Micro-USB interface and so force; and based on updated data interface, the two terminals are respectively applied to two different data interfaces.

Preferably, a portion the shell 2 corresponding to the front connection portion 111*a* of the first terminal 111 is provided with an installation opening 22; the front connection portion 111*a* of the first terminal 111 extends to the installation opening 22; the front end of the terminal component is flush with that of the shell 2; or the front end of the terminal component 1 is supersedes that of the shell 2 to prevent breaking of the front end of the module body 100. The front connection portion 121*a* of the second terminal 121 is located in the space surrounded by the module body 100 and the shell 2; and the terminal component 1 can achieve individual connection with a Lightning data interface and a Micro-USB interface from the two sides. The shell 2 is sleeved outside the terminal component to limit and fix the terminal component 1; the shell 2 is tightly sleeved outside the terminal component 1 to limit and fix the terminal component 1 transversely.

The elastic buckle 4 is inserted from the rear of the terminal component 1 forward into the terminal component 1 and its transverse movement is limited by the shell 2; the elastic chuck 41 at the front end of the elastic buckle 4 extends outwards from the sides of the terminal component 1 and the shell 2 at one side of the second terminal 121; and the elastic buckle 4 has the same structure as the Embodiment 1, so it is not repeated here.

The module body 100 of the corresponding first terminal 111 and the second terminal 121 can be in an integrated structure or in a separation structure. The integrated structure is that the first terminal 111 and the second terminal 121 are assembled on the module body 111 at the same time; the separation structure is that the first terminal 111 and the second terminal 121 are respectively assembled on the two module bodies 100. The terminal component 1 in the embodiment comprises a first module body 101 with a first terminal 111 and a second module body 102 with a second terminal 121; and the first module body 101 and the second module body 102 are stacked and relative limitation and fixation of the two module bodies on the front, rear, left and right sides is realized by convex-concave matching.

The assembly between the first terminal 111 and the first module body 101 as well as the assembly between the second terminal 121 and the second module body 102 is the same as that between the Lightning data interface terminal 111 and the first terminal plastic mold top 112 as well as between the Micro-USB interface terminal 121 and the second terminal plastic mold top 122 in Embodiment 1, so it is not repeated here.

Figure 8:
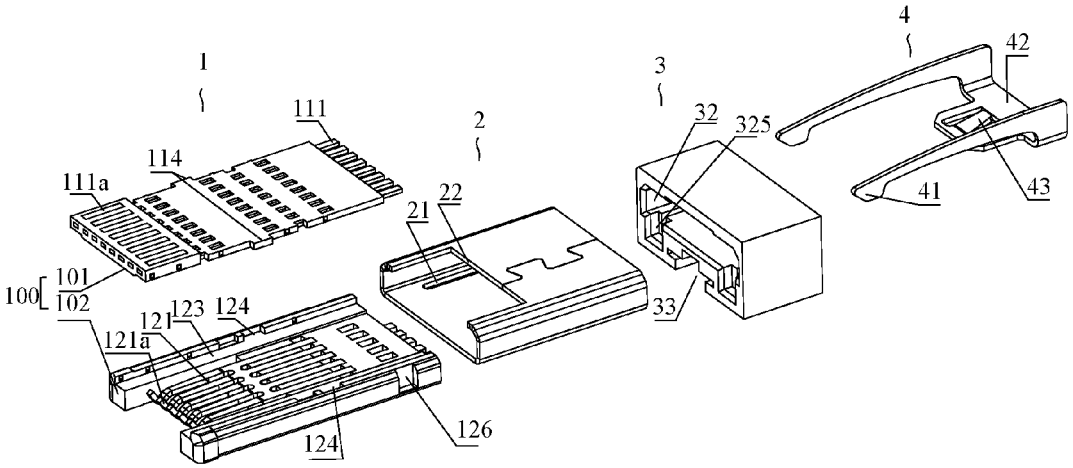
FIG. 8 is the structure explosive diagram of the Embodiment 2 in the utility model.
Figure 9:
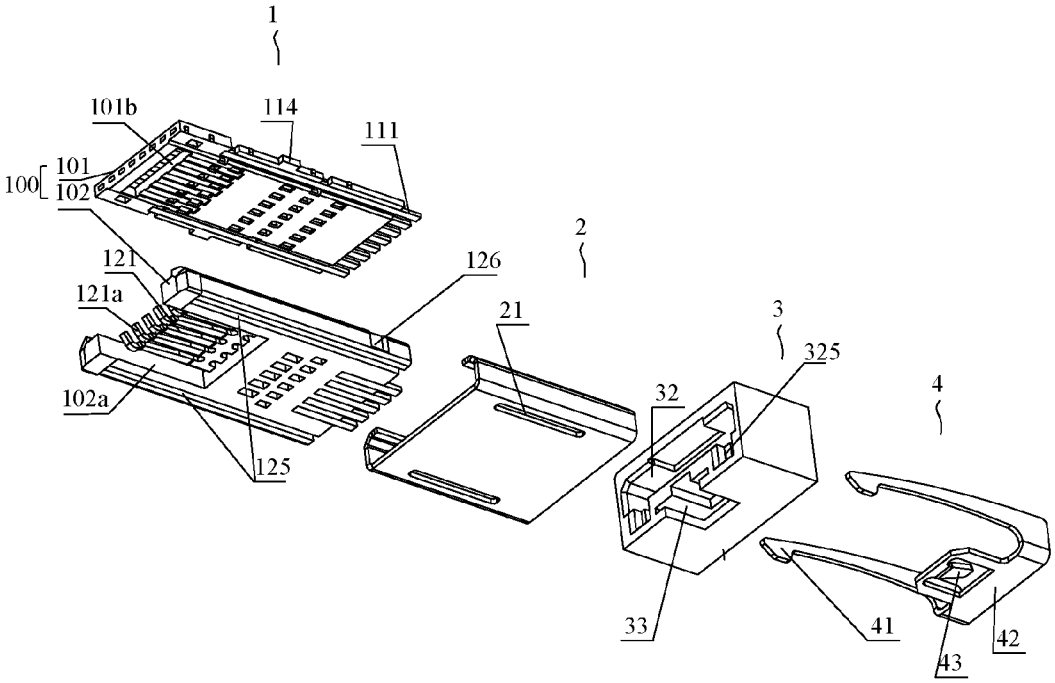
FIG. 9 is the structure explosive diagram in another direction of the Embodiment 2 in the utility model.

As shown in FIG. 8 and FIG. 9, the first module body 101 or the second module body 102 is provided with a through embedding groove 123; the first module body 101 or the second module body 102 is embedded into the embedding groove 123 to realize concave-convex matching; and the embedded first module body 101 and the second module body 102 can be limited in left and right directions. In the embodiment, the embedding groove 123 is set on the second module body 102; the front opening of the embedding groove 123 is provided with a second terminal 121; an opening 102*a* is set at the place where the front connection portion 121*a* of the second terminal 121 corresponds to the second module body 102; the front connection portion 121*a* of the second terminal 121 is suspended by the opening 102*a* so as to connect with the electronic equipment interface of Android phone, etc; and the rear portion of the second terminal 121 is connected with the connecting wire. The embedding groove 123 extends from the rear connection portion of the second terminal 121 to realize the electric connection between the second terminal 121 of the data interface of the Android system and the data wire. The rear connection portion of the first terminal 111 in the first module body 101 extends backwards from the embedding groove 123 so as to realize the electric connection between the first terminal 111 and the data wire.

The two sides of the embedding groove 123 are provided with a locating groove 124 respectively; the two sides of the first module body 101 or the second module body 102 are provided with positioning pieces 114; the positioning pieces 114 are inserted into the positioning groove 124 to limit the longitudinal movement of the first module body 101; and the shape of the positioning groove 124 matches with that of the positioning piece 114; and it is not limited here.

The assembly of the shell 2 and the terminal component 1 is the same as that the Embodiment 1. The reverse side of the shell 2 corresponds to the connection 21 extending from the elastic buckle 4 of the second module body 102; the installation opening 22 for the expose of the front connection portion 111*a* of the first terminal is arranged on the shell 2; the front connection portion 111*a* of the first terminal 111, namely, eight pins are exposed from the installation opening 22 to realize electric connection to electronic equipment interface, such as phone, etc. The structures of the first terminal 111 and the front connection portion 111*a* are the same as the prior art.

Figure 7:
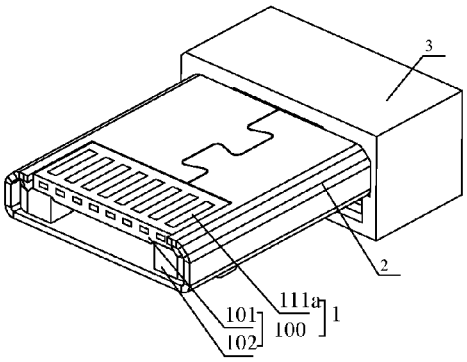
FIG. 7 is the structure diagram of the Embodiment 2 in the utility model.

The first terminal is as shown in FIGS. 7-9; a shift groove 101*b* for accommodating the movement of the front connection portion 121*a* of the second terminal 121 is disposed at the front back of the first module body 101; the shift groove 101*b* corresponds to the front connection portion 121*a* of the second terminal 121, so that the front connection portion 121*a* of the second terminal 121 is pressed to shift towards the shift groove 101*b* after the connector is inserted into the data interface of an electronic equipment, such as phone, etc. The shift groove 101*b* is a transverse long groove; its length corresponds to the length of the front connection portion 121*a* of the second terminal; and its depth can meet the moving distance after the front connection portion 121*a* is pressed.

As shown in FIG. 9, a buckle groove 125 is arranged on the second module body 102; two buckle grooves 125 are provided longitudinally along the second module body 102 at intervals; and two elastic buckles 41 are inserted into the buckle grooves 125. The structure and assembly of the buckle groove 125 and the elastic buckle 4 are the same as the Embodiment 1, so it is not explained here.

Figure 10:
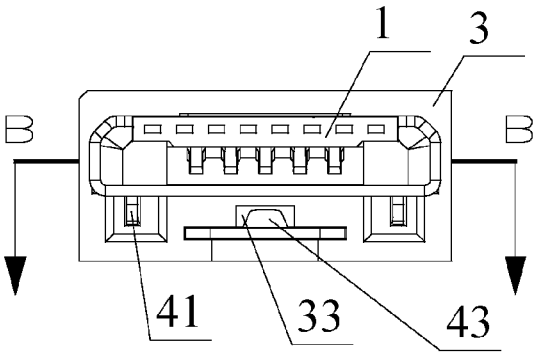
FIG. 10 is the plan view of the Embodiment 2 in the utility model.
Figure 11:
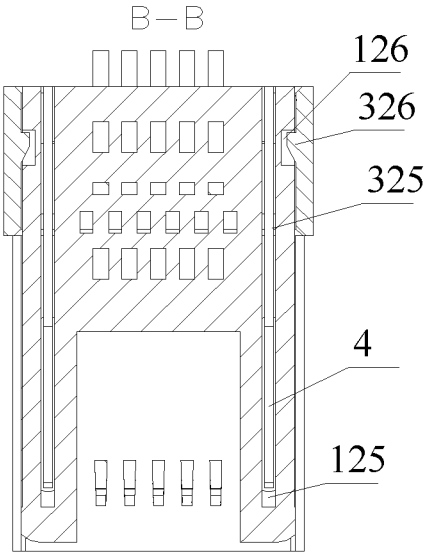
FIG. 11 is B-B section view in FIG. 10.
Figure 12:
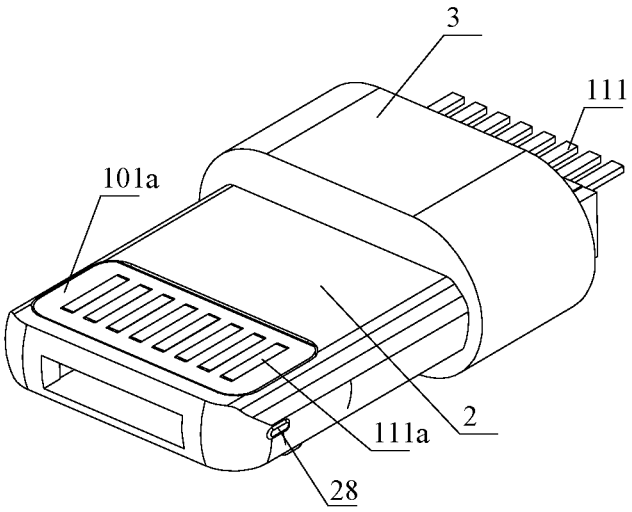
FIG. 12 is the structure diagram of the Embodiment 3 in the utility model.
Figure 13:
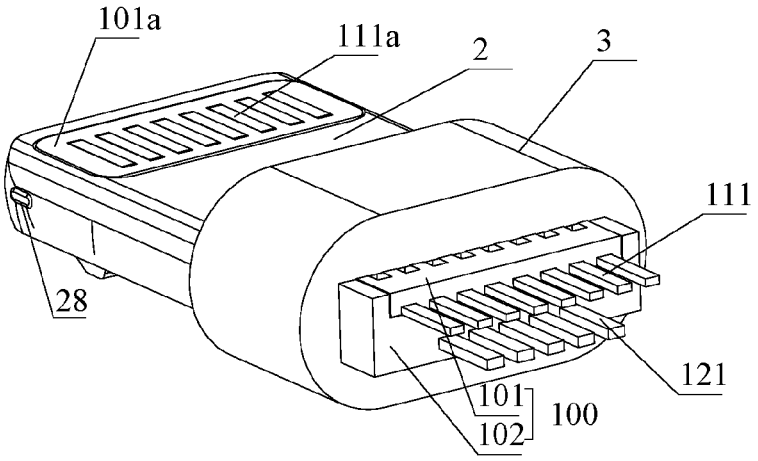
FIG. 13 is the structure explosive diagram in another direction of the Embodiment 3 in the utility model.
Figure 14:
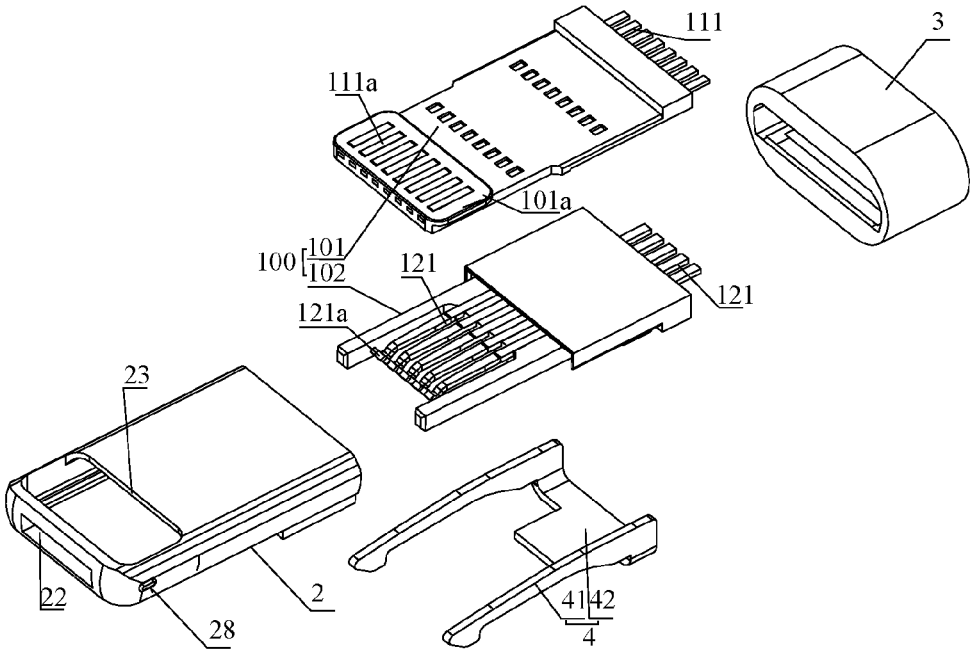
FIG. 14 is the structure explosive diagram of the Embodiment 3 in the utility model.

As shown in FIGS. 9-10, the backward limiting of the elastic buckle 4 is realized by pressing the resisting shrapnel 43 arranged in the middle portion or rear portion of the elastic buckle 4 against the backbase 3; the resisting shrapnel 43 is pressed against the resisting groove 33 or a resisting block set on the backbase 3 to prevent backward movement of the elastic buckle 4. The top groove 33 can be provided on the outer wall and front end of the backbase 3 as well as the inner wall of the backbase 3.

The backbase 3 is sleeved and snapped to the rear portion of the terminal component 1 to achieve a fixed connection between them. A shown in FIG. 11, in order to fix the terminal component 1 and the backbase 3, inner wall of the through groove 32 and the rear portion of the terminal component 1 are provided with a neck 126 and a chuck 326 respectively; and the structures of the neck 126 and the chuck 326 are the same as Embodiment 1.

Embodiment 3: The Embodiment is the Third Mode of Execution of the Connector

As shown in FIGS. 12-15, a double-side and dual-purpose connector, including a terminal component 1, a shell 2, a backbase 3 and an elastic buckle 4; the terminal component 1 comprises a module body 100, the first terminal 111 and the second terminal 121 are used for different types of data interfaces; the first terminal 111 and the second terminal 121 are fixed to and separated by the module body 100 so as to achieve separated terminal connection. The first terminal 111 and the second terminal 121 in the utility model are two different types of terminals which are used for connection terminals of Apple product and the connection terminals of Android system products. Based on the current phone product, the first terminal 111 is Lightning data interface and the like and the second terminal 121 is Micro-USB interface, etc. Based on the continuously updated data interface, the two terminals adapt to two different data interfaces.

The shell 2 is sleeved outside the terminal component 1 to limit and fix the terminal component 1; preferably the shell 2 is tightly sleeved outside the terminal component 1 to limit and fix the terminal component 1 transversely. The shell is in a all-surrounding integrated structure to wrap and fix both the terminal component 1 and the elastic buckle 4 only leaves an terminal connection opening for communication connection correspondingly to the terminal component 1. Under the protection of shell 2, the strength of the front end of the module body 100 of the plastic material is enhanced to prevent breaking the front end of the module body 100.

On the one hand, the shell 2 can be fixed by the tightening matching with the terminal component 1; and on the other hand, the shell 2 is clamped in the backbase 3 by the rear portion of the shell 2 to avoid longitudinal movement of the shell 2.

The elastic buckle 4 is partially embedded into the terminal component 1; the front end of the elastic buckle 4 extends outwards from the sides of the terminal component 1 and the shell; the rear portion of the elastic buckle 4 is limited and fixed by the terminal component 1 and the shell 2 to prevent moving of the elastic buckle 4.

As shown in FIGS. 12-15, the terminal component 1 comprises a first terminal 111 adaptable to electronic equipments, such as Apple phone and the like, a second terminal 121 adaptable to electronic equipments, such as Android system phone and the like, and a module body 100 for fixing and separating the terminal; and the front connection portion 111*a* of the first terminal 1 and the front connection portion 121*a* of the second terminal 121 are located at the front end of the module body 100. The utility model adopts double-side and dual-purpose connector; the position and the connection method of the front connection portion 111*a* of the first terminal 1 and the front connection portion 121*a* of the second terminal 121 correspond to the position and connection method of the electronic equipment of Android type and Apple phone to meet the requirements of the electronic equipment of corresponding Apple or Android phone correspond the two types of interfaces.

The module body 100 corresponding to the first terminal 111 and the second terminal 121 can be an integrated structure or separated structure. The integrated structure is that the first terminal 111 and the second terminal 121 are assembled on the module body 100 at the same time; the separated structure is that the first terminal 111 and the second terminal 121 are respectively assembled on two module bodies. The shapes of the first terminal 111 and the second terminal 121 are the same as that two types of terminals in the prior art; and explanations for the first terminal 111 and the second terminal 121 are not repeated here.

As shown in FIGS. 12-15, the utility model needs to realize the compatibility of two kinds of data interfaces; the terminal component 1 comprises a first module body 101*l* with a first terminal 111 and a second module body 102 with a second terminal 121; and the first module body 101 and the second module body 102 are stacked. The shell 2 is tightly sleeved outside the terminal component 1; the shell 2 is made from metal material, so the shell 2 can be grounded; on the other hand, the terminal component 1 is transversely limited and fixed. The shell 2 is all-surrounding integrated structure to wrap and fix the terminal component 1 and the elastic buckle 4; a terminal connection opening for communication connection is left correspondingly to the terminal component 1. The terminal connection opening comprises a first connection opening 23 at the front face of the shell 2 and a second connection opening 22 at the front end of the shell 2; the front connection portion 111*a* of the first terminal 111 is provided with a first connection opening 23; and the second connection opening 22 corresponds to the front connection portion 121*a* of the second terminal 121. The shape of the shell 2 matches with the shape of the four walls of the first module body 101 and the second module body 102 so that the shell 2 can wrap and fix the first module body 101 and the second module body 102; the shell 2 has the same shape with the current connector, so the interface shape can be directly used without changing. The connection opening 21 extending from the elastic buckle 4 is arranged on the second module body 102 corresponding to the shell 2.

In order to ensure the stability the insert connection between the connector and the electronic equipments, such as cell phones, an anti-falling mechanism preventing the connector falling is arranged on the shell 2; the anti-falling mechanism comprises an anti-falling piece 28 extruded outwards and set on the shell 2. The anti-falling piece 28 is a non-elastic part. The structure of the anti-falling piece 28 can be any outward extruding bump, bead, lug or the like; and the quantity is defined based on demands, without any limitation; when the bump and lug have a small volume, they can be arrange as an array; when the bump, bead and lug have a great volume, one or two are set at one position. The anti-falling piece 28 is a non-elastic structure, to form a tight fit or slightly deformed insertion with the interface wall of electronic equipment under the external force effect, so the inserting firmness of the connector and the electronic equipment is strengthened. The setting position of the anti-falling piece 28 is not limited; it can be set around the shell 2, as shown in FIGS. 12-15, it is optimally set on the two sides of the shell 2.

Figure 15:
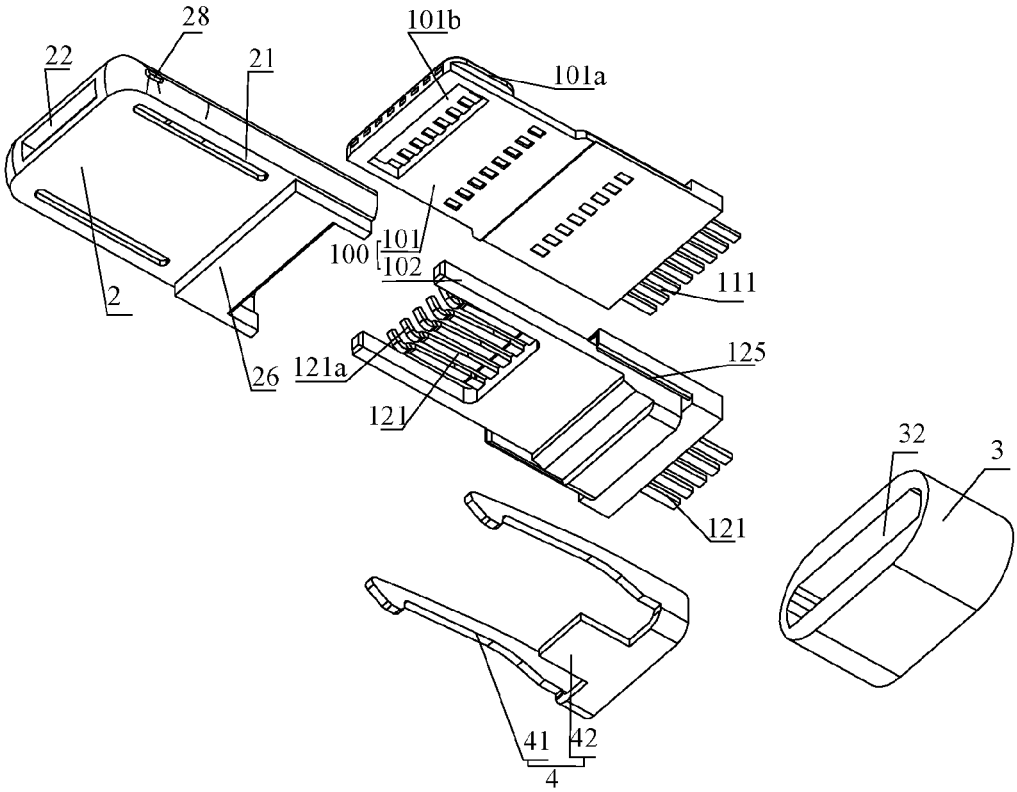
FIG. 15 is the structure explosive diagram in another direction of the Embodiment 3 in the utility model.

As shown in FIG. 15, a containing groove 101*b* for containing the movement of the front connection portion 121*a* of the second terminal 121 is provided at the front back of the first module body 101; after assembling the first module body 101, the second module body 102, the second terminal 121 and the first terminal 111, the containing groove 101*b* corresponds to the front connection portion 121*a* of the second terminal 121, so that the front connection portion 121*a* of the second terminal 121 is pressed to shift to the containing groove 101*b* after the connector is inserted into the data interface of the electronic equipment, such as phone, etc. The containing groove 101*b* is a transverse long groove; its length corresponds to the front connection portion 121*a* of the second terminal 121; its depth meets the moving distance after the pressed front connection portion 121*a*; the bottom of the containing groove 101*b* must have a certain thickness to avoid weakening of the strength and thus and breaking of the module body 100 after setting the containing groove 101*b*.

As shown in FIGS. 12-15, it is preferable the elastic buckle 4 comprises two elastic chucks 41 arranged in interval and in parallel; the shape, position and action of the elastic chuck 41 are the same as those of the elastic chuck 41 in the interface of the Android system product in the prior art so as to realize common interface of the electronic equipment of the current phone. The rear portions of the two elastic chucks 41 are integrally connected by the buckle base 42; the buckle base 42 is transversely provided at the rear portion of the elastic chuck 41 so as to connect the two elastic chucks 41 integrally.

As shown in FIG. 15, the buckle groove 125 corresponding to the elastic chuck 41 is respectively arranged at the back of the second module body 102; two buckle grooves 125 are longitudinally arranged along the second module body 102; the buckle grooves 125 extend to the middle of the second module body 102 from the rear portion of the second module body 102; the rear portion of the elastic chuck 41 is inserted into the buckle groove 125; and the front part of the elastic buckle 41 extends to the buckle groove 125. The front part of the elastic buckle 41 is suspended, so that the assembled elastic chuck 41 has greater moving space to finish assembling smoothly. When the shell 2 covers the terminal component 1, the elastic buckle 4 can be limited and fixed.

There are multiple connection relations among the backbase 3, terminal component 1 and the shell 2; one connection relation is that the backbase 3 is fixed at the rear portions of the terminal component 1 and the shell 2 by injection molding; and the terminal component 1 is fixedly and integrally connected with the shell 2. When the groove 26 extruding outwards is injected to the backbase 3, it can increase the consolidation ability and prevent the backbase 3 from separating from the shell 2. The other connection relation is the same as the Embodiments 1 and 2. The inner wall of the through groove 32 of the backbase 3 and the rear portion of the terminal component 1 are provided with neck and chuck; and after the neck is connected with the chuck, the separation between the backbase 3 and the terminal component 1 can be limited.

Embodiment 4: It is the Fourth Embodiment Method of the Utility Model

Figure 16:
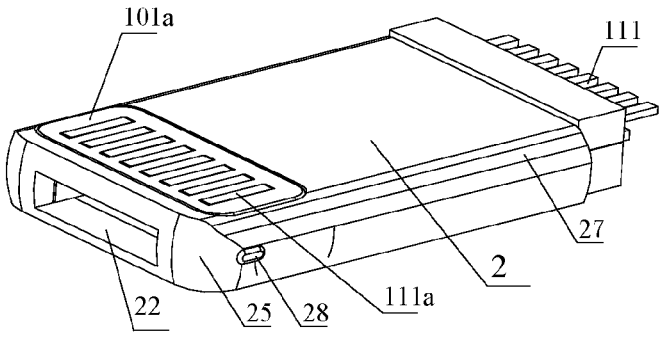
FIG. 16 is the structure diagram of the Embodiment 4 in the utility model.
Figure 17:
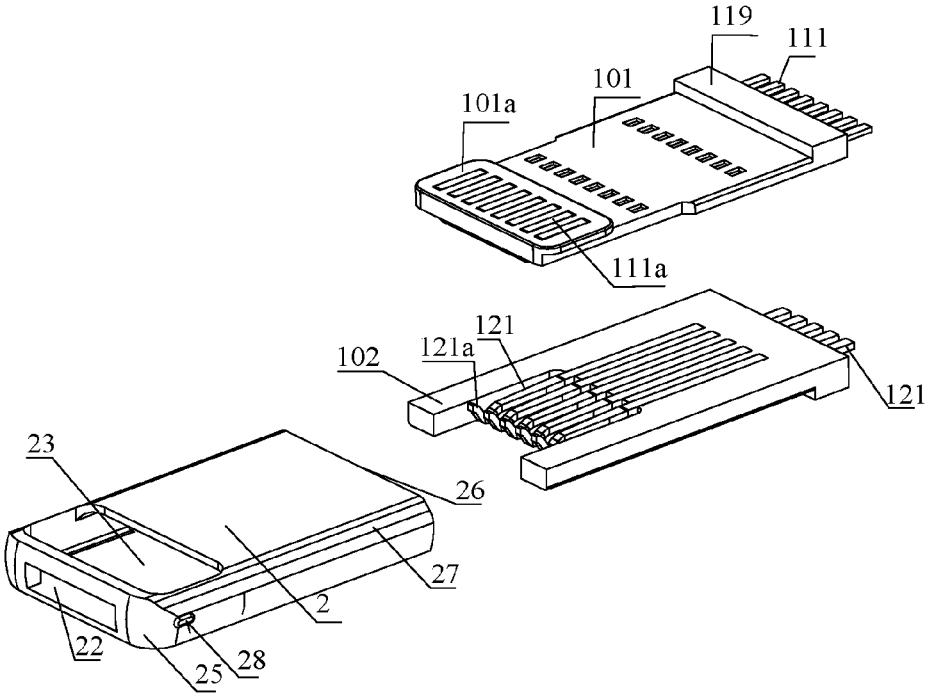
FIG. 17 is the structure explosive diagram of the Embodiment 4 in the utility model.
Figure 18:
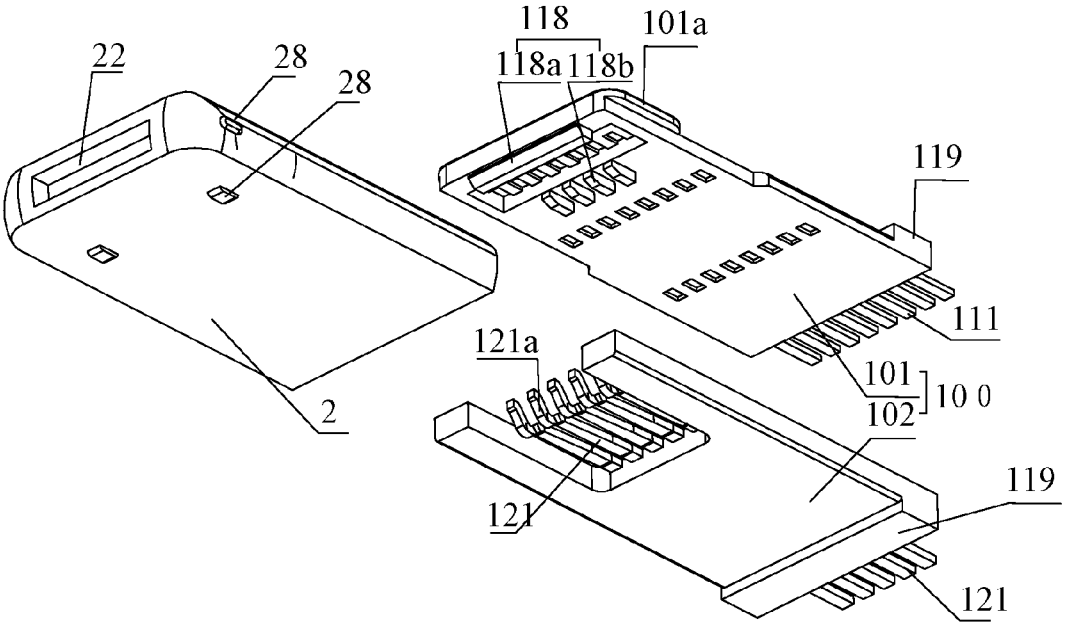
FIG. 18 is the structure explosive diagram in another direction of the Embodiment 4 in the utility model.

As shown in FIGS. 16-18, a double-side and dual-purpose connector, comprising a terminal component 1 and a shell 2; and the backbase and the elastic buckle are not provided in this embodiment.

The terminal component 1 comprises a module body 100 as well as a first terminal 111 and a second terminal 121 which are used for different types of data interfaces. The first terminal 111 and the second terminal 121 are fixed and separated by the module body 100 to realize terminal connection. The first terminal 111 and the second terminal 121 are two kinds of terminals which are used for the connection terminals of Apple product and Android system product.

As shown in FIGS. 16-18, the terminal component 1 comprises a first terminal 111 adaptable to the electronic equipment, such as Apple phone and the like, a second terminal 121 adapting to the electronic equipment, such as Android system phone and the like as well as a module body 100 for fixing and separating each terminal; and the front connection portion 111*a* of the first terminal 111 and the front connection portion 121*a* of the second terminal 121 are located at the front end of the module body 100. The concrete structure of the terminal component 1 is the same as the Embodiment 3. The terminal component 1 comprises a first module body 101 with a first terminal 111 and a second module body 102 with a second terminal 121; and the first module body 101 and the second module body 102 are stacked.

As shown in FIGS. 16-18, the shell 2 is tightly sleeved outside the terminal component 1; the shell 2 is made from metal material; on one hand, the shell 2 can realize grounding; on the other hand, the terminal component 1 can be transversely limited and fixed. The shell 2 is embedded in the terminal component 1 to realize fixing the shell 2 and the terminal component 1. The shell 2 is full-surrounding integrated structure to wrap and fix the terminal component 1; the terminal connection opening for communication connection is left correspondingly to the terminal component 1; the terminal connection opening comprises a first connection opening 23 at the front face of the shell 2 and a second connection opening 22 set at the front end of the shell 2; the front connection portion 111*a* of the first terminal 111 is provided in the first connection opening 23; and the second connection opening 22 corresponds to the front connection portion 121*a* of the second terminal 121. The concrete structure is the same as the Embodiment 3.

As shown in FIGS. 16-18, a plug locking piece 118 for increasing the plugging force of the terminal is arranged on the terminal component 1 corresponding to the second connection opening. The plug locking piece 118 is specifically provided at the back of the first module body 101. The plug locking piece 118 comprises an inclined locking block 118*a* at the front end of the back of the first module body 101 transversely and a clamping piece 118*b* corresponding to the second terminal; the inclined surface of the inclined locking block 118*a* faces to the second connection opening 22, so that the space of the second connection opening 22 is gradually reduced from the outside to the inside so as to increase the plug force among the tongue pieces of the data interface on the phone base; and it is stably connected. Multiple clamping pieces 118*b* are longitudinally set along the second terminal; the clamping piece 118 can clamp and fix the second terminal to reduce the transverse shift of the second terminal and keep the electrically connected stability. The clamping piece 118*b* is provided with inclined surface facing to the second connection opening 22 to compress the tongue piece of the data interface on the phone base and increase the plug force.

As shown in FIGS. 16-18, the utility model is not provided with backbase; and the shell is fixed by the terminal component. The front portion of the terminal component and the rear portion of the terminal component are provided with baffle pieces; and the shell is clamped, limited and fixed to prevent the longitudinal movement of the shell 2. The baffle piece at the front portion of the terminal component can be the baffle piece 101*a* provided at the front portion of the first module body; the surface of the baffle piece 101*a* is higher than that of the first module body 101, so that the surface of the baffle piece 101*a* fixed in the first connection opening 23 is flush with that of the shell 2. The baffle pieces 119 at the rear portion of the terminal component are specifically set at the rear portions of the first module body 101 and the second module body 102; and there are one or multiple baffle pieces 119. In the embodiment, the rear portions of the first module body 101 and the second module body 102 are provided with a baffle piece respectively; the distance between the baffle piece 101*a* at the front portion of the terminal component and the baffle piece 119 at the rear portion of the terminal component 1 matches with the length of the shell 2, so that the shell 2 is fixed between the baffle piece 101*a* and the baffle piece 119.

An arc-shaped walls 25 matching with a data interface shape are arranged at the two sides of the front of the shell 2 and/or terminal component 1; the structure adapts to the data interface shape of Apple product; the two sides of the shell 2 are provided with inclined face 27 matching with another data interface shape as well as the data interface shape adapting to Android system product. The shell 2 of the embodiment is all-surrounding structure; and arc-shaped wall 25 is provided on the shell 2.

An elastic buckle is not provided in the embodiment; in order to ensure the plug stability of the electronic equipment, such as connector, phone and the like, an anti-falling mechanism preventing the connector falling is arranged on the shell 2; and the anti-falling mechanism comprises an anti-falling piece 28 extruded from the shell 2. The concrete structure of the anti-falling pieces 28 at the two sides of the shell 2 is the same as the embodiment 3. It is not repeated here. Apart from the anti-falling pieces 28 at the two sides of the shell 2, the surface of the shell is provided with anti-falling piece 28. The anti-falling piece 28 at the back of the shell can be bump and bead structure; one or more bump and bead can be set; the shape is not limited to realize anti-falling.

Other structures of the terminal component 1 are the same as those in Embodiment 3, and is not repeated here.

Figure 19:
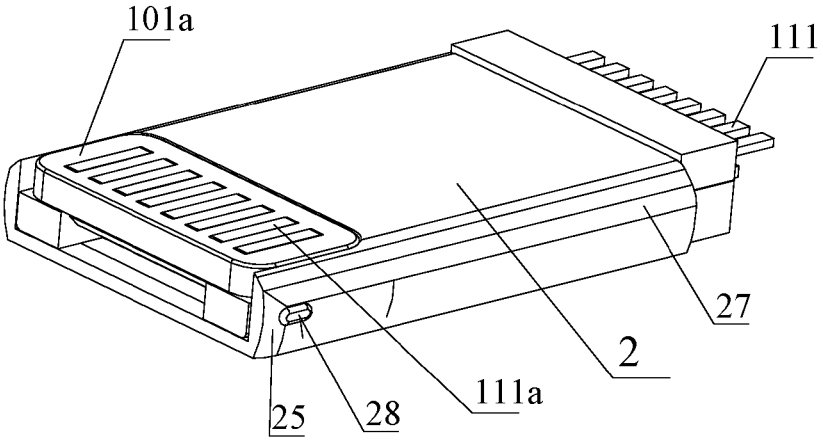
FIG. 19 is the structure diagram of the Embodiment 5 in the utility model.
Figure 20:
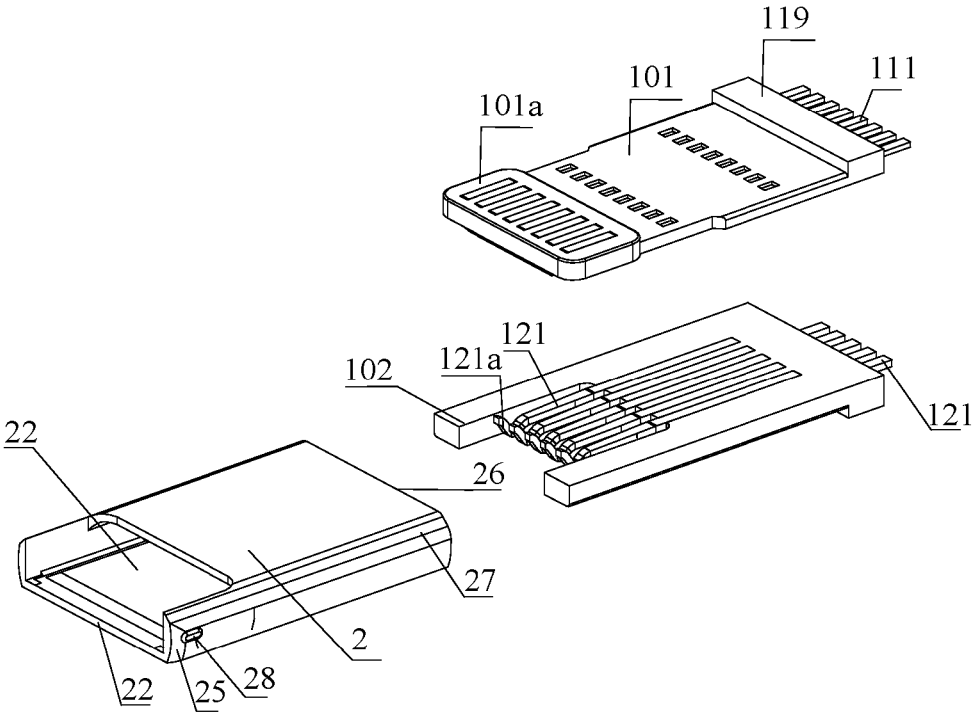
FIG. 20 is the structure explosive diagram of the Embodiment 5 in the utility model.
Figure 21:
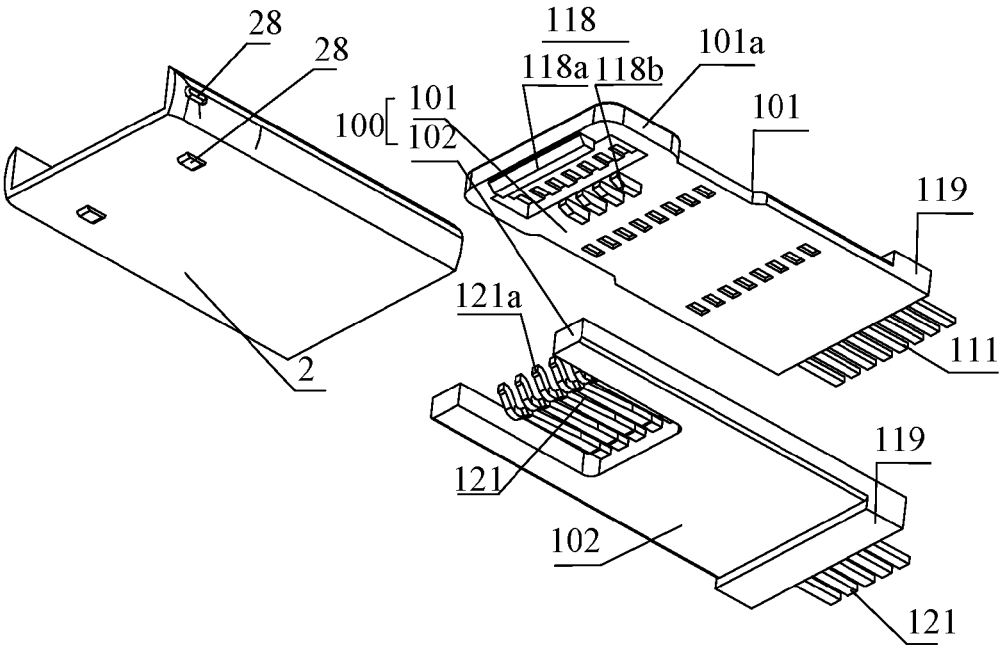
FIG. 21 is the structure explosive diagram in another direction of the Embodiment 5 in the utility model.

Embodiment 5 as shown in FIGS. 19-21, it is the fifth mode of execution of double-side and dual-purpose connector. The structure is the same as those in Embodiment 4. The structure of the shell 2 of the embodiment is different from that of the Embodiment 4; other structures are the same and is not repeated here.

As shown in FIGS. 19-21, the shell 2 is in a cylindrical configuration with front and rear openings. The terminal component 1 is wrapped and fixed; the cylinder structure is the through openings of the shell 2; the front portion of the shell 2 is provided with a first connection opening 23; the front opening is the second connection opening 22; the rear opening is the third connection opening 26. The front connection portion 111*a* of the first terminal 111 is set in the first connection opening 223; the second connection opening 22 corresponds to the front connection portion 121*a* of the second terminal 121; and the rear ends of the first terminal 111 and the second terminal 121 extend backwards from the third connection opening 26.

As shown in FIGS. 19-21, the shell is a cylindrical structure; the front two sides of the shell 2 and/or the terminal component 1 are provided with arc-shaped walls 25 mating the data interface shape. If the front end of the shell 2 is flush with the front end of the terminal component 1, arc-shaped walls 25 are arranged at the front ends of the shell 2 and the terminal component 1. The structure adapts to the data interface shape adapting to the Apple product; the two sides of the shell 2 are longitudinally provided with inclined surface 27 matching with another data interface shape; and the inclined surface 27 adapts to the data interface shape of the Android system product.

The invention claimed is:

1. A double-side and dual-purpose connector comprising:

a terminal component;

a shell;

the terminal component comprising a first terminal and a second terminal which are isolated from one another and are adaptable to different data interface types;

different types of data interfaces connections being achieved by the first terminal and the second terminal;

the shell being tightly sleeved outside the terminal component to limit and fix the terminal component;

an elastic buckle;

the elastic buckle being inserted into the terminal component;

a front portion of the elastic buckle extending from two sides of the terminal component and the shell;

a backbase; and the elastic buckle and the backbase being limited and fixed by the terminal component to prevent moving of the elastic buckle.

2. The double-side and dual-purpose connector according to claim 1, wherein the backbase is fixed to a rear portion of the terminal component, so that the terminal component is fixedly and integrally connected with the shell; and a rear end of the terminal component extends from the rear portion of the backbase.

3. The double-side and dual-purpose connector according to claim 1, wherein the backbase is provided with a through groove; the shape of the through groove matches with that of a rear portion of the terminal component to be inserted together; and the shell is pressed against a portion between a front end of the terminal component and the backbase.

4. The double-side and dual-purpose connector according to claim 3, wherein an inner wall of the through groove and the rear portion of the terminal component are provided with a neck and a chuck respectively; and detachment between the backbase and the terminal component is limited after the neck is connected with the chuck.

5. The double-side and dual-purpose connector according to claim 1, wherein a resisting shrapnel is provided in a middle portion or a rear portion of the elastic buckle; and the resisting shrapnel resists in a top pressing groove provided on the backbase to prevent the elastic buckle from moving backwards.

6. The double-side and dual-purpose connector according to claim 1, wherein an anti-falling mechanism for preventing falling of the connector inserted is arranged on the shell or/and the terminal component.

7. The double-side and dual-purpose connector according to claim 1, wherein the first terminal is a Lighting data interface terminal; the second terminal is a Micro-USB interface; the terminal component is realized by connecting the Light data interface and the Micro-USB interface from the two sides;

the backbase is connected with a back of the terminal component to realize the fixing connection of the backbase and the terminal component; the shell is held between a front end of the terminal component and the backbase to prevent the shell moving longitudinally;

the elastic buckle is inserted into the terminal component from a rear of the terminal component and the transverse movement is limited by the shell; the elastic chuck at the front end of the elastic buckle extends from the terminal component at one side of the Micro-USB interface; and the elastic buckle is longitudinally limited and fixed between the terminal component and the backbase to prevent the longitudinal moving thereof.

8. The double-side and dual-purpose connector according to claim 7, wherein the terminal component comprises a first terminal component with a Lighting data interface and a second terminal component with a micro-USB interface; the first terminal component and the second terminal component are stacked to limit and fix front, rear, right and left sides by concave-convex matching.

9. The double-side and dual-purpose connector according to claim 8, wherein the second terminal component is provided with a containing groove; the first terminal component is embedded in the containing groove; a rear of the containing groove is opened; a rear of the first terminal component extends backwards from an opening of the containing groove; the two sides of the containing groove are provided with locating grooves; the two sides of the corresponding first terminal component are provided with locating pieces; and the locating piece is inserted into the locating groove to limit the longitudinal moving of the first terminal component.

10. The double-side and dual-purpose connector according to claim 8, wherein the elastic buckle comprises two elastic chucks arranged in parallel and in interval; the rear portions of the two elastic chucks are integrally connected; the corresponding second terminal component is provided with a buckle groove respectively; the elastic chucks are contained in the buckle grooves; and the front end of the elastic chuck extends outwards from the connection opening of the buckle groove and the shell.

11. The double-side and dual-purpose connector according to claim 8, wherein the backbase is provided with a through groove; a locking groove is set on the inner wall of the through groove; a baffle plate is provided at the front end of the terminal component; the front end of the shell is pressed against the baffle plate; and the rear end of the shell is pressed against the locking groove by the locking piece.

12. The double-side and dual-purpose connector according to claim 3, wherein the terminal component further comprises a module body; the first terminal and the second terminal are fixed and separated by the module body to realize connecting the terminal; and the front connection portion of the first terminal and the front end connection portion of the second terminal are arranged at the front of the module body.

13. The double-side and dual-purpose connector according to claim 12, wherein the module body comprises a first module body used for fixing the first terminal and a second module body used for fixing the second terminal; and the first module body and the second module body are stacked to limit and fix the front, rear, right and left sides by concave-convex matching.

14. The double-side and dual-purpose connector according to claim 12, wherein the elastic buckle comprises two elastic chucks arranged in interval and in parallel; the rear portions of two elastic chucks are integrally connected by the buckle; the second module body is provided with a buckle groove; the elastic chuck is contained in the buckle groove; and the front end of the elastic chuck extends outwards from the connection opening corresponding to the buckle groove and shell.

15. The double-side and dual-purpose connector according to claim 12, wherein the shift groove for containing the movement of the connection portion at the front end of the second terminal is provided at the front back of the first module body; the shift groove aims at the front end of the second terminal, so that the second terminal is pressed and shifted in the shift groove after the connector is inserted into the phone data interface.

16. The double-side and dual-purpose connector according to claim 1, wherein the shell is full-surround structure or cylindrical structure with front and rear opening; the terminal component is wrapped and fixed; the front portion of the shell is provided with the first connection opening; a front end is provided with a second connection opening; a rear end is provided with a third connection opening; a front end connection portion of the first terminal is set in the first connection opening; the second connection opening corresponds to the front end connection portion of the second terminal; and rear connection portions of the first terminal and the second terminal extend backwards from the third connection opening.

17. The double-side and dual-purpose connector according to claim 16, wherein a plugging locking piece for increasing the plugging force of the terminal is arranged on the terminal component corresponding to the second connection opening.

18. The double-side and dual-purpose connector according to claim 16, wherein the front portion and a rear portion of the terminal component are provided with blocking pieces to limit and fix the shell.

19. The double-side and dual-purpose connector according to claim 1, wherein an arc-shaped wall matching with a data interface is provided at the two sides of front ends of the shell or/and terminal component; and an inclined face matching with another data interface is arranged longitudinally at the two sides of the shell.

* * * * *